United States Patent [19]

Bayne et al.

[11] Patent Number: 4,773,812

[45] Date of Patent: Sep. 27, 1988

[54] RECEPTACLE LIFT AND SLIM PROFILE POWER UNIT THEREFOR

[75] Inventors: Jimmy O. Bayne; Robert E. Wyman, both of Simpsonville, S.C.

[73] Assignee: Bayne Machine Works, Inc., Simpsonville, S.C.

[21] Appl. No.: 44,045

[22] Filed: Apr. 29, 1987

[51] Int. Cl.[4] ..... B65F 3/02

[52] U.S. Cl. ..... 414/408; 92/136; 414/421

[58] Field of Search ..... 414/303, 406, 408, 420, 414/421, 425; 92/136

[56] References Cited

U.S. PATENT DOCUMENTS

| | | | |
|---|---|---|---|
| 3,327,876 | 6/1967 | Kolling | 414/406 |
| 3,738,516 | 6/1973 | Wells | 414/406 X |
| 3,747,785 | 7/1973 | Dahlin | 414/406 X |
| 3,931,901 | 1/1976 | Jones | 414/406 |
| 4,167,897 | 9/1979 | Bunyard | 92/136 X |
| 4,365,922 | 12/1982 | Borders | 414/406 |
| 4,489,640 | 12/1984 | Olson | 92/136 X |
| 4,613,271 | 9/1986 | Naab | 414/421 X |

FOREIGN PATENT DOCUMENTS

| | | | |
|---|---|---|---|
| 844262 | 7/1949 | Fed. Rep. of Germany | 414/406 |
| 358747 | 1/1962 | Switzerland | 414/406 |

*Primary Examiner*—Robert J. Spar
*Assistant Examiner*—David A. Bucci
*Attorney, Agent, or Firm*—Dority & Manning

[57] ABSTRACT

A lifting apparatus includes two pairs of lift arms having respective displaced pivot points on a movable carriage for projecting such carriage up into a refuse-receiving opening of a garbage truck, and in an inverted position so as to dump the contents of a receptacle held on such carriage. The two pairs of arms are also axially nested in a co-planar orientation when the carriage is in its fully lowered position, so as to minimize the overall width of the lifting apparatus. A particular hydraulic rotary motor having a relatively thin width may be used to actuate the apparatus. The hydraulic rotary motor utilizes meshed rack and pinion teeth generally within the confines of a cylinder thereof for minimizing the width of the cylinder block. Also, the rack and pinion teeth remain enclosed within such cylinder immersed in hydraulic fluid passing therethrough so as to lubricate the moving components for prolonging their service life with less maintenance. A plurality of cylinders may be aligned in parallel, and share a common pinion gear output shaft, with each cylinder having a reciprocating piston rod supporting rack teeth for engagement with such pinion gear. A lifting apparatus as presently described in combination with the disclosed hydraulic rotary motor can have minimized width while still being capable of repetitively handling full weight loads with reduced maintenance and projecting same a selected distance up into a garbage truck, which also reduces the need for successive compaction of the dumped receptacle contents after each dumping cycle.

27 Claims, 6 Drawing Sheets

Fig. 5.
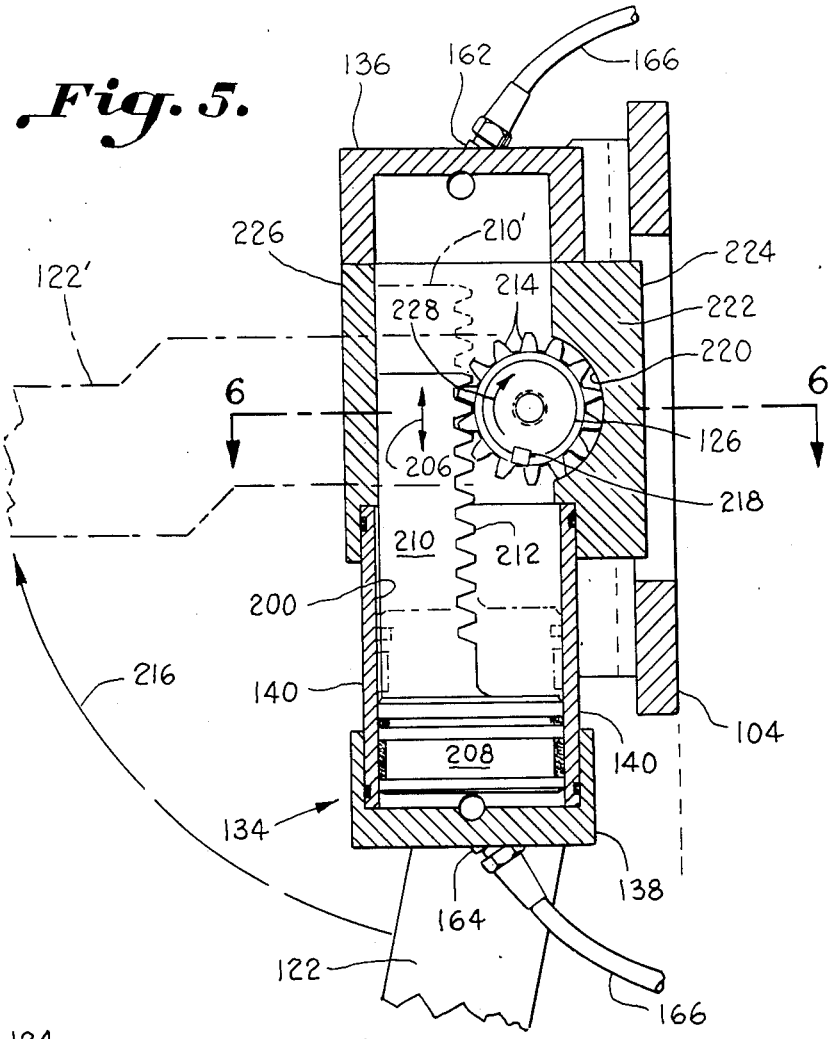
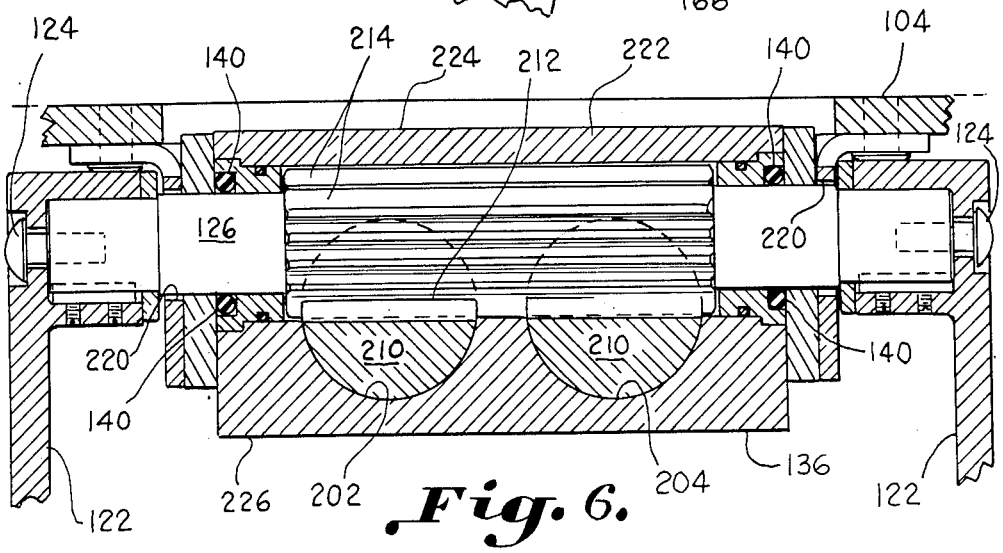
Fig. 6.

RECEPTACLE LIFT AND SLIM PROFILE POWER UNIT THEREFOR

BACKGROUND OF THE INVENTION

This invention in general concerns a lift apparatus and drive therefor, and in particular it concerns a trash receptacle lift for use with a refuse-gathering vehicle, and a slim profile rotary motor which may be used to actuate such a lift.

In recent years, conventional residential trash cans which must be manually emptied into the back of a refuse-gathering vehicle have been increasingly replaced with a somewhat standardized trash receptacle which has wheels for ease of transportation by a resident between his or her house and curb side, and which is further adapted to be lifted and dumped with a power lift unit mounted on the refuse-gathering vehicle (i.e garbage truck). The construction and operation of various waste receptacle dumping mechanisms are known. See for example, Brown et al. (U.S. Pat. No. 3,804,277, issued Apr. 16, 1974); Shive (U.S. Pat. No. 3,894,642, issued July 15, 1975); and Wyman et al. (U.S. Pat. No. 4,479,751, issued Oct. 30, 1984), each of which generally disclose a movable carriage adapted for receipt of a receptacle thereon, the contents of which are to be dumped into a garbage truck. Each movable carriage is generally supported on arms which are actuated by various drive means, such as hydraulic actuators, for raising and substantially inverting the movable carriage so as to dump the receptacle contents into a garbage truck on which the lift unit is mounted. The disclosures of such patents are incorporated herein by reference.

While different companies, such as Zarn, Inc., of Reidsville, North Carolina, and Applied Plastics Company, also of North Carolina, market various lift units adapted for specific use with particular styles of receptacles, most of such receptacles have certain generally standard features. For example, many typical receptacles have a single axle with wheels on each end of such axle to permit the receptacle to be rolled about by the user. An extended handle bar or its equivalent permits ready manipulation and required tilting of the receptacle so that it may roll on its two wheels. The side of the receptacle opposite such handle bar typically has an engagement member located about 34 inches above ground level. By appropriate tilting of the receptacle as it is brought into position to be lifted, such engagement member may be hooked onto a fixed element of the lift apparatus movable carriage, so that the receptacle may be raised and inverted by the lift apparatus.

Obviously, such gravity-type engagement feature would, if used by itself, be defeated during inversion of the movable carriage. To prevent such occurrence, various movable engagement hooks are activated during dumping of the receptacle to engage it at an additional point thereon below the above-mentioned fixed element so as to retain the receptacle on the movable carriage while it is being inverted. The above-identified patents also each disclose examples of such engagement means and their operation during a receptacle dumping cycle.

While such types of lift devices and associated receptacles generally permit mechanized dumping (as opposed to manual), various drawbacks and inefficiencies persist. For example, such prior art receptacle dumping mechanisms typically tend to dump the contents of the receptacle only near the very back of the refuse-receiving opening of the garbage truck. A typical garbage truck has a large opening located at its rear to provide access to a relatively large trash container carried on the truck. A dumping apparatus as discussed above is usually mounted adjacent such opening, such as on a rear bumper of the truck. A built-in trash compactor is also present in the container for compacting refuse therein. If the contents of the receptacle are dumped only at the very back of such refuse-receiving opening (as is often the case), a compaction cycle (i.e. operation of the built-in compactor of the garbage truck) must be run after almost each successive receptacle dumping so as to push the dumped contents forward, i.e. away from the very rear of the garbage truck, to make room for the next dumping. Having to frequently repeat compacting cycles is very time consuming, since a garbage truck normally would include a great number of stops at relatively short intervals on its route, and also adds to wear and tear on the compactor equipment.

Another drawback of such prior art mechanized dumping devices is the sheer size of the unit itself. Many prior art dumping devices have a width (i.e. projection from the rear bumper of the garbage truck) in a range of about 16 to 20 inches. That range is without the trash receptacle mounted for dumping. A safety hazard is thus presented by structure which projects substantially from the rear of the vehicle, particularly since it cannot be seen by the driver of the truck.

Also, as an additional practical matter, garbage trucks outfitted with such prior art (relatively thick) dumping apparatuses for smaller residential trash receptacles cannot be simultaneously used for dumping larger commercial trash dumpsters. Such dumpsters are normally pivoted against pivot members mounted at the rear of the truck itself while being winched upward with a powered cable mounted at the top of the garbage truck. Such dual use of a garbage truck is normally not possible with the typical prior art residential receptacle dumping device because there is not sufficient clearance for the commercial dumpster to be pivoted on the truck-mounted pivot members around the prior art residential dumping devices due to their relatively thick width.

Additionally, some refuse-gathering vehicles have their refuse-receiving openings on the sides of the truck, rather than at their backs. Such side-loading vehicles typically cannot safely use such prior art dumping devices again because they generally extend too far from the side of the truck.

SUMMARY OF THE INVENTION

The present invention recognizes and addresses the above-noted drawbacks and disadvantages of typical prior art residential receptacle dumping apparatuses, as well as other drawbacks of such devices.

It is a general object to provide an improved lifting device. It is a more specific object of the present invention to provide a lifting apparatus having a width (when folded) which is substantially less than typical prior art lifting devices, so as to alleviate many of the width-related drawbacks discussed above.

In providing a slim profile lifting apparatus, particularly for use with a refuse-gathering vehicle, it is a further object of this invention to provide a correspondingly reduced-width power drive unit for such lifting mechanism. More generally, it is an object to provide such an improved drive unit suitable for drive applications other than receptacle lifting mechanisms. In providing such an improved drive unit, it is another object of this invention to provide improved maintenance characteristics for such drive units.

It is yet a further object of the present invention to provide a lifting apparatus having maintenance characteristics, in part by virtue of incorporating the above-mentioned improved power drive unit, and further by virtue of requiring less frequent operation of a compactor unit for the refuse-gathering vehicle with which the present invention is used. In accordance with such general object, it is a more specific object of this invention to provide a lifting apparatus which dumps receptacle contents a predetermined distance up into the refuse-gathering vehicle so that it is not necessary to operate the vehicle compactor after each successive dumping cycle. In furtherance of such general object, it is another more specific object and feature of the present invention to provide a dumping apparatus for which such predetermined distance may be adjusted so as to adapt the dumping apparatus for use with a particular refuse-gathering vehicle.

While various power drive units and lifting apparatuses embodying different combinations of presently disclosed features may comprise various embodiments in accordance with the present invention, one exemplary apparatus, in accordance with this invention, for dumping the contents of a receptacle into a refuse-gathering vehicle adapted for gathering such contents, comprises: a support frame adapted to be mounted onto a refuse-gathering vehicle; drive means, supported by the support frame, and having a rotatable output shaft, such drive means controllably positioning the rotary orientation of the output shaft; a carriage adapted for carrying a receptacle for dumping of the contents thereof, such carriage being pivotably supported relative the apparatus for controlled movement with respect thereto; first arm means for pivotably supporting the carriage relative the support frame; and second arm means for pivotably supporting the carriage relative the output shaft; wherein selected operation of the drive means causes controlled pivoting of the carriage on respective ends of the first and second arm means, between a lowered, upright position of the carriage for receiving a receptacle thereon and a relatively raised, inverted position of the carriage for emptying a receptacle received thereon.

Another exemplary embodiment of a receptacle dumping apparatus in accordance with the present invention, for mounting on a refuse-gathering vehicle having an opening therein adapted for receiving refuse into the vehicle, comprises: a support base for being integrally associated with such a refuse-gathering vehicle near the refuse-receiving opening thereof; relatively narrow-width hydraulic power means, received on the support base, and having a rotatable output shaft, for selectively operating responsive to the controlled passage of hydraulic fluid therethrough so as to control the rotary orientation of the output shaft; a receptacle carriage for carrying a receptacle for the dumping thereof; and dual paired projection arm means, pivotably associated with the support base and the power means, respectively, for supporting and selectively positioning the carriage, such arm means being operatively driven by the power means output shaft for lifting and projecting the carriage together with any receptacle carried thereby up into the vehicle refuse-receiving opening while substantially inverting the carriage so as to dump into the vehicle the contents of any such receptacle carried by the carriage.

Still another example of a receptacle lift in accordance with the present invention, for attachment to a refuse truck for lifting and dumping the contents of refuse-filled receptacles into such truck, comprises: a support plate having first and second opposing sides, the first side being adapted for attachment to a substantially vertical planar area of a refuse truck; a movable carriage for receipt of a receptacle thereon, such carriage being continuously movable between a first position for initially receiving such a receptacle, and a second position for holding such receptacle in a substantially inverted position for dumping of the contents thereof into the refuse truck; hydraulic rotary motor means, fixely secured to the second side of the support plate, and having at least one hydraulically-drivable reciprocable piston and a rotatable drive shaft respectively supporting rack and pinion gear teeth, which rack and pinion gear teeth are mutually engaged and situated substantially within at least one cylinder of the rotary motor means, the drive shaft being rotatably driven by hydraulically-controlled reciprocable positioning of the piston within the cylinder, and such drive shaft further being disposed substantially parallel to the support plate, with opposing ends of the drive shaft emerging from the rotary motor means; a first pair of carriage support arms, respective ends thereof being fixedly secured to one of each of the drive shaft opposing ends for rotation therewith, and the other ends of such first pair of arms being defined as relatively moving ends thereof which are pivotably engaged with the movable carriage; and a second pair of carriage support arms, respective ends thereof being pivotably engaged with the second side of said support plate, and the other ends of such second pair of arms being defined as relatively moving ends thereof which are pivotably engaged with the movable carriage; wherein the movable carriage is continuously movable between the first and second positions thereof carried on the defined moving ends of the first and second respective pairs of support arms whenever the rotary motor means is controllably actuated.

More particularly concerning the power drive unit presently disclosed in accordance with the present invention, one example of a fluid-actuated motor in accordance with this invention comprises: a housing having first and second ports for the passage of fluids therethrough, an output shaft opening, and at least one cylinder within the housing; at least one piston matably received in the housing cylinder for fluid-powered reciprocable movement therein; a piston rod, secured to the piston for movement therewith, and having gear teeth therealong; and an output shaft rotatably received in the housing and extending through the output shaft opening thereof so as to project from the housing, the output shaft being provided with teeth thereabout and positioned so that such output shaft teeth engage the piston rod gear teeth such that the output shaft is rotated by reciprocable movement of the piston; whereby a load secured to the output shaft projecting from the housing may be selectively powered by reciprocable movement of the at least one piston with controlled introduction of fluids through the housing ports.

Another embodiment of a hydraulic rotary motor in accordance with this invention comprises: housing means adapted for the controlled flow of hydraulic fluids therethrough; piston means received in the housing means for controlled hydraulically-actuated reciprocable movement therein, such piston means including a piston rod supporting rack teeth thereon; and pinion gear output shaft means, operatively associated with the housing means and projecting therefrom, for being rotatably driven by engagement of pinion teeth thereof with the rack teeth of the piston means; whereby the output shaft means may be rotated for driving a load by controlled reciprocable movement of the piston means.

While various specific features and aspects of this invention are disclosed herewith so as to provide a complete and enabling description of the present invention, those of ordinary skill in the art will recognize numerous variations and modifications to such features and aspects of this invention which may be practiced in accordance with the invention. All such modifications, use of equivalents, reversal of parts, or the like, are intended to come within the spirit and scope of the present invention by virtue of present reference thereto.

BRIEF DESCRIPTION OF THE DRAWINGS

A complete and enabling description of the present invention, including the best mode thereof, is more particularly set forth in the following specification, together with reference to the accompanying drawings, in which:

FIG. 5 illustrates a side cross-sectional view of an exemplary power drive unit in accordance with the present invention, as taken along the cross-sectional lines indicated in present FIG. 2;

FIG. 6 illustrates a transverse sectional view of the exemplary power drive unit in accordance with the present invention in FIG. 5, taken along the indicated sectional lines of such figure.

Figure 1:
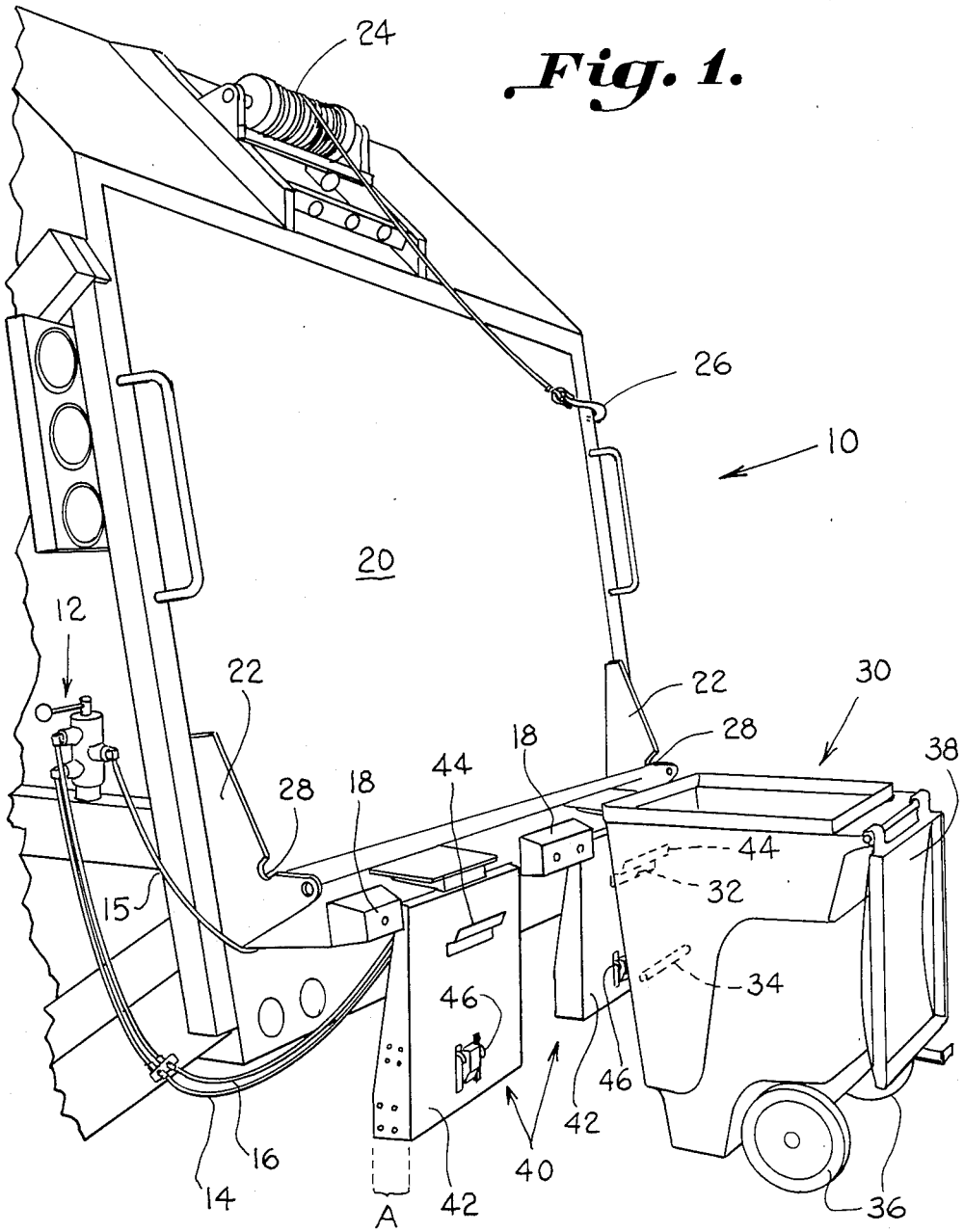
FIG. 1 provides a perspective view of a refuse-gathering vehicle having a rearwardly located refuse-receiving opening, with two lifting devices in accordance with the present invention associated therewith.

Repeat use of reference characters throughout the following specification and accompanying drawings is intended to represent same or equivalent elements or features of the invention.

DETAILED DESCRIPTION OF THE PREFERRED EMBODIMENTS

While use of a lifting apparatus in accordance with the present invention is not limited to a rear loading refuse-gathering vehicle, FIG. 1 illustrates one preferred configuration for use of an embodiment of this invention mounted on the rear of such a vehicle. The rear of such a vehicle 10 includes a refuse-receiving receiving opening 20 into which the contents of a receptacle 30 may be dumped with one of a pair of lifting devices 40, provided in accordance with the present invention. While various power drive units may be practiced in accordance with such lifting apparatus 40, including the slim profile hydraulic rotary motor disclosed below, a variety of driving units may be used to actuate lift arms of the device 40, operation of which is discussed below in greater detail.

Preferably, the hydraulic rotary motor of this invention as presently disclosed is used with lift 40, and is controllably actuated by a conventional hydraulic valve 12, which is linked with the hydraulic rotary motor through a pair of hydraulic lines 14 and 16, as understood by those of ordinary skill in the art. Line 15 may provide hydraulic pressure to valve 12. Additional details of typical hydraulic control lines and cooperation thereof with a hydraulic mechanism are known, as set forth for example in the United States Patents identified above in the Background of the Invention, the disclosure of which patents is incorporated by reference.

Similar in a general sense to typical prior lifting mechanisms, the present device 40 has a generally planar movable carriage 42 on which a receptacle 30 is received to be dumped. Receptacle 30 includes upper and lower engagement members 32 and 34, respectively, which cooperate with engagement elements of lifting devices 40 in a generally known fashion, undrstood to those in the art. Engagement element 32 is preferably about 34 inches above ground level, while the corresponding fixed engagement element 44 of the lifting apparatus 40 is preferably slightly higher above ground level. When lifting apparatus 40 is in its lowered position illustrated in FIG. 1, a receptacle 30 may be rolled on its wheels 36 into position adjacent movable carriage 42, with the lid 38 of such receptacle opened in anticipation of the contents thereof being dumped into opening 20 of garbage truck 10. Once so positioned, receptacle 30 may be tilted back on its wheels 36, and guided into contact with the planar surface of movable carriage 42 such that fixed engagement element 44 of device 40 is registered and engaged with engagement element 32 of the receptacle.

Normally, during a dumping cycle in which movable carriage 42 is pivoted into a raised, inverted position (from its illustrated lowered, upright position) so that the contents of receptacle 30 are dumped into opening 20 of truck 10, a movable engagement element 46 of lifting apparatus 40 automatically engages lower engagement feature 34 of receptacle 30 so as to prevent the receptacle itself from falling into the truck. Such movable engagement feature for operating during a dumping cycle may be provided in a variety of ways, the specific details of which form no particular features of the present invention. Examples of such engagement features operative during a dumping cycle are disclosed in the above-identified U.S. Patents, incorporated by reference.

More particular features of the present lift unit, including its operative structure thereof, are not seen in the view illustrated in present FIG. 1 since especially the lift arms and power drive unit for the lift unit are behind planar movable carriage 42. However, FIG. 1 well illustrates the relatively slim profile of the width A of a lifting apparatus in accordance with the present invention relative garbage truck 10 and receptacle 30. Width A varies even for different embodiments of the present invention; however, widths generally in the range of from about 4 to about 8 inches (and more preferably of about 4¾ inches) are possible with the present invention, compared with typical widths of 16 to 20 inches for many prior art lifting apparatuses.

Relatively slim lift unit widths specifically overcome many drawbacks of prior art structures, as discussed in the above Background of the Invention. For example, since lifting devices 40 in accordance with this invention project from the rear of a truck bumper no further than stops 18 thereof, truck 10 may also be outfitted with conventional pivot elements 22 and a winch mechanism 24. As known in the art, a hook 26 may be mounted on the end of a cable of such wench 24 and used to raise a commercial trash dumpster about pivot points 28 provided by pivot elements 22 so that a commercial dumpster may be emptied into opening 20 of truck 10. Since width A of lifting apparatus 40 of this invention is relatively narrow in comparison with some prior art lifting apparatuses discussed above with reference to the cited patents, the advantage is gained that truck 10 can be concurrently outfitted for alternatively lifting either receptacles 30 (with lift unit 40) or commercial dumpsters (using such devices as members 22, 24, 26 and 28 mounted on truck 10).

Figure 2:
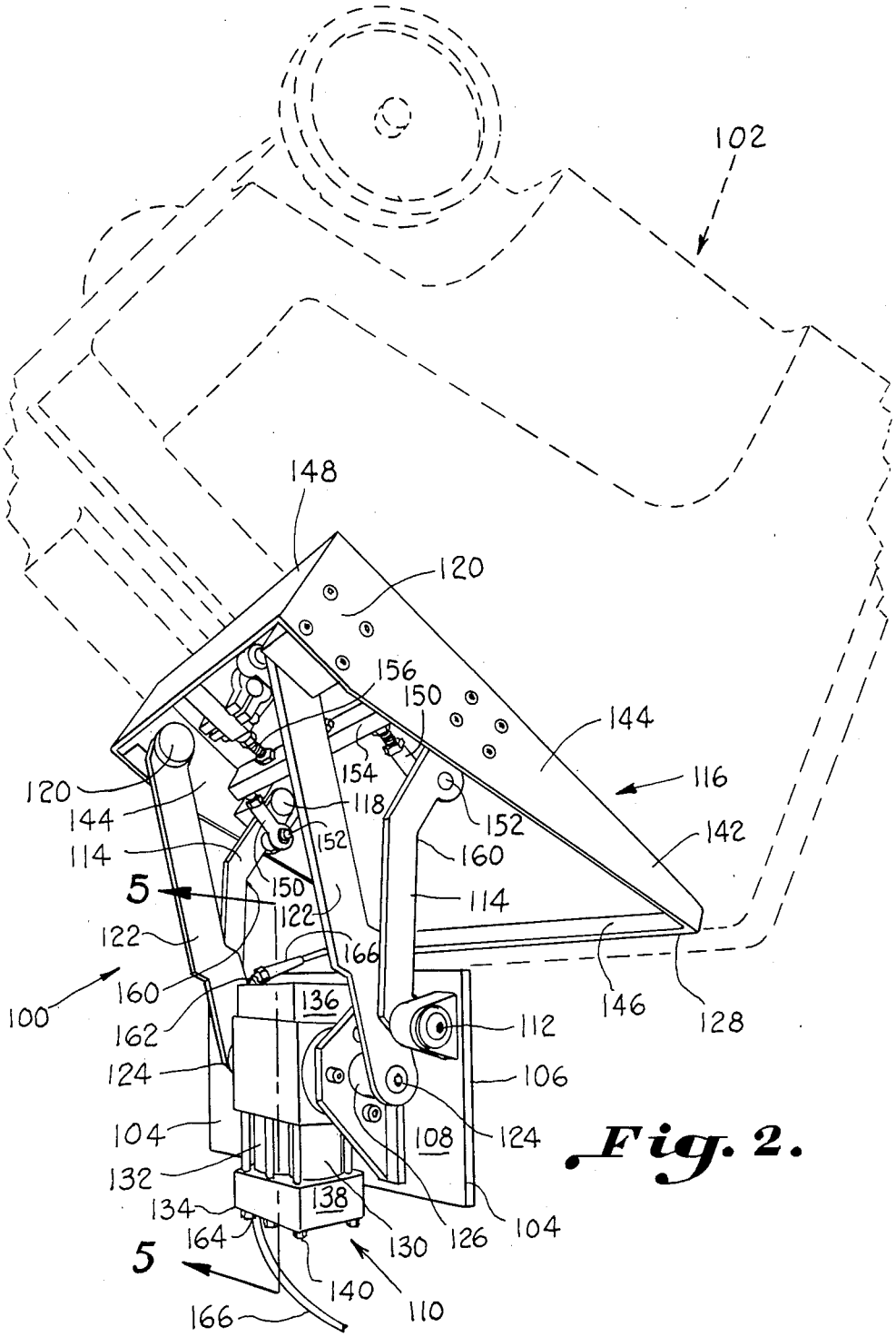
FIG. 2 illustrates a perspective view of an exemplary lift apparatus in accordance with the present invention, with a typical trash receptacle for use therewith supported on such lift in a raised, inverted position thereof, so that contents of the receptacle may be dumped into a refuse-gathering vehicle.
Figure 3:
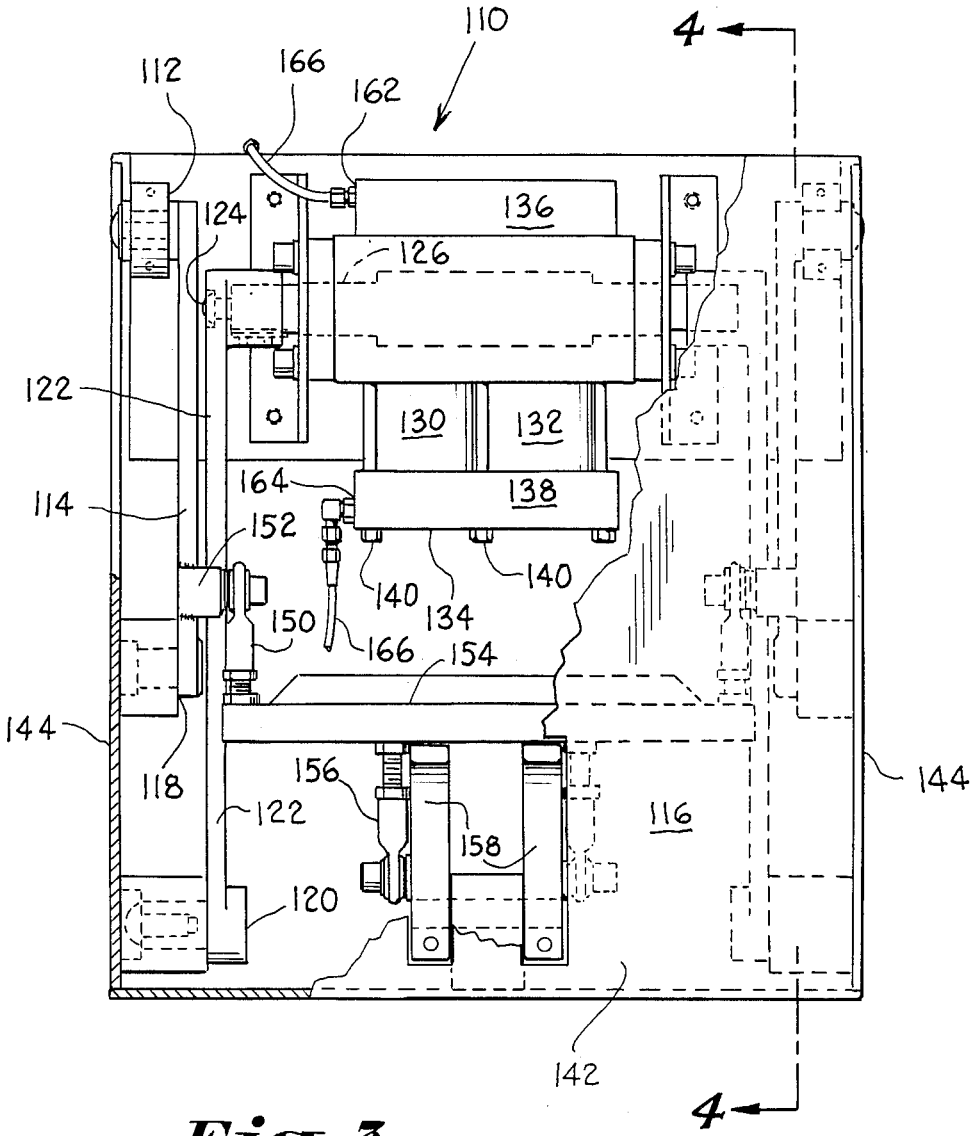
FIG. 3 illustrates, in partial cutaway, a plan view of an exemplary lifting apparatus in accordance with the present invention, in its folded (i.e. lowered) position.

The remaining disclosure more specifically describes features and aspects of lifting apparatus 40 which are not apparent from the illustration of present FIG. 1. Referring now to FIGS. 2 and 3, operative details of a dumping apparatus 40 as shown in FIG. 1 are illustrated. FIG. 2 shows a perspective view of a lifting apparatus 100 in accordance with the present invention (shown in solid line) supporting in a raised, inverted position a receptacle 102 (shown in dotted line), which FIG. 3 illustrates in partial cutaway a plan view of the FIG. 2 lift unit in a folded or closed, i.e. lowered, position thereof.

A support frame 104 is preferably planar, and has two sides. Side 106 is adapted to be secured, such as by welding or with bolts or the like, to a refuse-gathering vehicle or other structure with which the lifting mechanism is to be used. Preferably, side 106 is removably welded to the back metal bumper of a vehicle, as exemplified by present FIG. 1; however, alternative installations of the present lifting apparatus, including those for other than express use as a trash receptacle dumping device, come within the scope of the present invention.

An opposite side 108 of frame 104 supports a drive means 110, one example of which is discussed in greater detail in FIGS. 5 and 6 below. Frame 104 also supports a pair of pivot points 112 (only one of which is seen in the illustration of FIG. 2) for a pair of pivoting arms 114, which comprise a first arm means for pivotably supporting movable carriage 116 (substantially the same as movable carriage 42 of present FIG. 1) relative support frame 104. Both ends of each of arms 114 are pivotably mounted at their respective connections, with a pair of pivots 118 for defined relatively moving ends of arms 114 being supported by movable carriage 116 itself.

Respective pivot points 118 of the first arm means are displaced a selected distance on the movable carriage from a second pair of pivoting points 120 for a second pair of arms 122. Though pivotally connected to carriage 116 at their defined relatively moving ends 120, such arms 122 are fixedly connected at their opposite ends 124 to a rotatable drive shaft 126 of drive means 110. Such output or drive shaft 126 preferably has two respective ends which project from drive means 110, so that each of the arm ends 124 may be respectively secured thereto for simultaneously rotating their respective relatively moving arm ends 120 through an arc having a radius the length of arms 122 whenever shaft 126 is rotated, as discussed below. Arms 122 generally comprise a second arm means for pivotably supporting carriage 116 relative such output shaft 126.

The respective lengths of arms 122 and 114, together with the displacement of their pivot points 118 and 120 on carriage 116, determine a distance which the front edge 128 of movable carriage 116 is projected behind support frame 104 on side 106 thereof whenever a receptacle 102 is fully raised to its inverted position (as illustrated in FIG. 2). Such lateral translation of receptacle 102 actually serves a useful purpose, i.e. to project the receptacle a predetermined distance up into the refuse-receiving opening of the garbage truck so that the contents of the receptacle are dumped forwardly into the truck, at least some distance from the very rear of the truck. Accordingly, projection dumping provides the benefits discussed in the Background of this Invention with reference to reduced need for frequent operation of a compactor device of the garbage truck.

Yet another feature of the present invention, better illustrated in present FIG. 3, concerns the nesting or co-planar resting of the four arms preferably used to selectively raise and project movable carriage 116. Pivots 124 of longer arms 122, which are directly powered by drive means 110 for actually raising and lowering movable carriage 116, are positioned axially inward of pivots 112 of shorter arms 114, so that such arms are in co-planar alignment whenever they are folded for positioning movable carriage 116 in its lowered, upright position. Output shaft 126 extends through drive unit 110 and is controllably rotated thereby, and is also adapted for fixed driving engagement on either drive end thereof with arm ends 124, for example by a key or keyway.

While the precise construction of different drive units 110 may vary considerably, and a given lifting device in accordance with this invention is not limited to a particular type or form of a drive unit, a hydraulically-actuated two cylinder rack and pinion mechanism, as presently disclosed, is one preferred construction. In general, a pair of cylinders 130 and 132 are held in parallel alignment, axially displaced from one another by housing 134, and with output shaft 126 commonly passed through such cylinders for being rotated thereby in a manner discussed below. Briefly, pistons received within such cylinders are hydraulically actuated, as understood by those of ordinary skill in the art, so as to be controllably reciprocated. Each piston is outfitted with a piston rod having rack teeth thereon, which rack teeth are suitably positioned to engage pinion teeth supported about output shaft 126 for controllably rotating same responsive to the controlled reciprocation of each such piston. Housing 134 generally may include upper and lower blockheads 136 and 138, respectively, and which are joined by bolts 140 or the like. Other features of exemplary drive unit 110 are discussed below in greater detail with reference to FIGS. 5 and 6.

Movable carriage 116 is partially cutaway in present FIG. 3 to permit illustration of the present operative structure normally hidden therebehind (as in present FIG. 1). Movable carriage 116 primarily includes a planar surface 142 for contacting and supporting a trash receptacle 102, as illustrated with respect to planar surface 42 of present FIG. 1. Planar surface 142 is integrally associated with side flanges 144, which provide support for bearings or the like which in turn receive arms 114 and 122 at pivot points 118 and 120 thereof, respectively. Top and bottom flanges 146 and 148 cooperate with side flanges 144 to form a complete apron around the lifting apparatus, and into which the apparatus folds for protection thereof whenever it is in its lowered, upright position (as illustrated in present FIG. 1).

Movable engagement element 46 (illustrated in FIG. 1), which is operative during the dumping cycle of a lifting apparatus of this invention to retain a receptacle thereon, is driven by a linkage system which interconnects preferably between the pair of arms 114 and the movable carriage 116 itself. More specifically, an adjustable linkage member 150 connects to a pivot point 152 on each respective arm 114 a selected distance from the moving end pivot 118 thereof. The other end of each respective linkage member 150 is connected with a transverse element 154, which is further controllably linked with adjustable linkages 156 for rotating movable engagement members (hooks) 158 themselves as lifting apparatus 100 passes through its dumping phase. In other words, hooks 158 are projected outward from surface 142 of movable carriage 116 to latch onto a receptacle received on the carriage as such carriage is moved towards, through and from its raised, inverted position.

Additional structure and operation of such linkage system need not be discussed in detail for an enabling disclosure of this invention, in view of incorporation by reference of the above-cited patents. However, the lengths of linkage members 150 may be readily adapted to compensate for dynamic changes in the spatial relationship between pivots 152 and transverse element 154, resulting from changes to the lengths of arms 122 or 114, or changes to the respective carriage pivot points 120 and 118 thereof. The displacement on carriage 116 of such pivot points, which contributes to the projection of front edge 128 of carriage 116 up into a refuse-receiving opening, is enhanced while retaining the above-discussed co-planarity of arms 122 and 114 by providing a bend 160 in each of arms 114.

Drive unit 110 may in practice comprise virtually any type of driving system for controllably rotating (i.e. actuating) pivot ends 124 of arms 122. However, a hydraulic rotary motor, as briefly discussed above, is preferred. Housing 134 may be provided with a pair of hydraulic fluid ports 162 and 164, to which conventional hydraulic control lines 166 may be connected for controlled actuation of drive means 110. Housing 134 is generally sealed other than the hydraulic fluid ports 162 and 164 thereof so as to also retain such fluid for lubricating the moving parts and meshing teeth therein. The only other opening in such housing preferably comprises an output shaft opening or openings to permit shaft 126 to pass therethrough.

Figure 4:
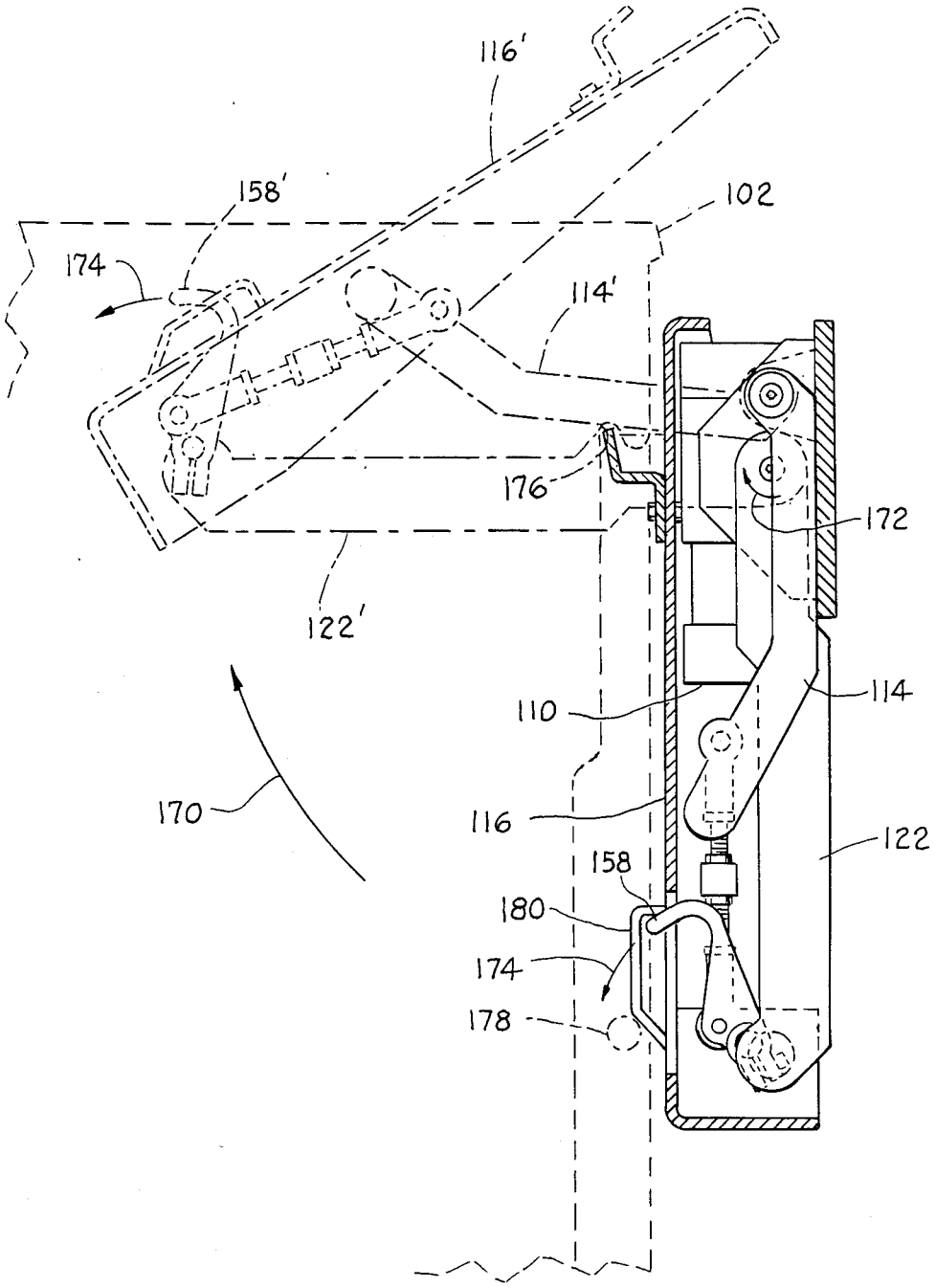
FIG. 4 illustrates a side cross-sectional view of the exemplary embodiment of the present invention illustrated in FIG. 3 taken along the cross-sectional lines indicated in such figure, with a dotted line progressional view of such lifting apparatus in operation.

Referring now to FIG. 4, a side cross-sectional view of the FIG. 3 embodiment is illustrated in accordance with the sectional lines of such FIG. 3. Where possible, repeat use is made of reference characters from FIGS. 2 and 3 so as to minimize the need for repeated detailed discussion of such FIG. 4 features.

FIG. 4 primarily illustrates a solid line view of the aforementioned side cross-section, and a dotted line view of the carriage and its supporting arms partially moved towards its raised, inverted position illustrated in present FIG. 2. As drive means 110 rotates arms 122 in the direction of arrow 170 by rotating its output shaft in the direction of arrow 172, carriage 116 is advanced to an intermediate raised position 116'. During such movement the previously discussed linkage mechanism, operative with controlled movement of arms 114, functionally drives movable engagement member 158 in the direction of arrows 174 so that garbage receptacle 102 is engaged at both its upper engagement point 176 and its lower engagement point 178. Thus, receptacle 102 remains fully in contact with movable carriage 116, even in the inverted position thereof. Such linkage for driving movable engagement member 158 is discussed in detail above with reference to FIGS. 2 and 3; hence, specific reference characters for each such linkage members are not repeated in FIG. 4 so as to retain clarity of the illustration thereof.

It should be noted however that movable engagement member 158 is preferably fully retracted behind a contact plate 180 which initially contacts lower engagement member 178 as receptacle 102 is brought into engagement with movable carriage 116. Thus, the width of the movable engagement feature of the present invention is also relatively minimized so as to retain a slim profile character for the overall lifting apparatus. As discussed above, such lifting apparatus can provide the slim profile advantages and the projecting advantages of this invention while using a variety of different driving mechanisms for powering the actuating arms 122 thereof. The dual pair of arms, as well as the nested configuration thereof, advantageously contributes to such features of this invention, which are further contributed to by the particular hydraulic rotary motor presently disclosed.

FIGS. 5 and 6 more particularly illustrate rotary motor which are preferred drive means 110 for use with the presently disclosed lifting apparatus, and which may be used alternatively for providing output power to virtually any other desired load which may be rotatably driven. FIG. 5 comprises a sectional view of the drive unit illustrated in present FIG. 2; accordingly, reference characters from such FIG. 2 are in part repeated so as to minimize repetitive description of the rotary power means.

Housing means 134 includes a lower blockhead 138 and an upper blockhead 136, which cooperates with bolts 140 or the like to retain at least one cylinder 200 therein. As shown by the further transverse sectional view of FIG. 6 (taken along the lines illustrated in present FIG. 5), preferably two cylinders 202 and 204 are provided, though one or more cylinders of selected like diameters may be used.

Regardless of how many cylinders are used in a given embodiment, each cylinder is preferably provided with a piston means reciprocally received therein, as illustrated by arrow 206 of FIG. 5. Such piston means may include a piston head 208 with a diameter slightly smaller than the inside diameter of cylinder 200, and having a piston rod 210 integrally associated therewith and extending longitudinally within such cylinder. As best illustrated by FIG. 6, piston rod 210 is preferably of semi-circular construction so as to longitudinally bi-sect cylinders 202 and 204. Furthermore, rack teeth 212 are provided along the face of piston rod 210 which is nearest the center of its respective cylinder. Such rack teeth cooperate with pinion teeth 214 supported around shaft 126, which shaft has a rotational axis which runs transversely to the direction of the plane of movement 216 of arms 122 for lifting a movable carriage (whenever the hydraulic rotary motor of FIG. 5 is used with a lift apparatus as described above). A key 218 is provided for fixedly securing rotatable output shaft 126 to a desired load, such as lift arms 122. Teeth 212 and 214 are meshed in relatively tight tolerances of several thousandths of an inch so as to provide tight control to the moving end of arm 122 and smooth rack and pinion operation.

As another feature of this invention, the rack and pinion gear teeth are substantially received within the confines of their respective cylinder (e.g. cylinder 200) so that hydraulic fluids received therein for controllably powering the reciprocable piston means also serve to lubricate all such parts as well as the rack and pinion teeth, thus considerably lessening the required maintenance of the power unit. Other than hydraulic fluid ports 162 and 164, output shaft opening or openings 220 are the only openings in the otherwise sealed housing means 134. Also, such output shaft openings may be provided with various seal members, particularly as illustrated in present FIG. 6, so as to prevent escape of any hydraulic fluid or the loss of hydraulic pressure within cylinder 200 (or cylinders 202 and 204).

Additionally, housing means 134 includes a slightly enlarged region 222 which cooperates with upper blockhead 136 for enclosing output shaft 126 and the pinion gear teeth 214 thereof. The necessary width of such member 222 adds to the minimum width of the overall hydraulic rotary motor, the full width of which is defined by opposing faces 224 and 226 thereof.

In operation, the hydraulic rotary motor of FIGS. 5 and 6 may be operatively associated with virtually any rotatably driven load, and is particularly suited for use with the present slim profile lifting mechanism, due to the relatively narrow width of the rotary motor itself. Such compactness is in part achieved by providing the piston rod and pinion output shaft substantially within the cylinder of the hydraulic rotary motor, as illustrated in the Figures. Those of ordinary skill in the art will understand that during operation hydraulic fluid is passed through hydraulic control lines 166 in either one of the two flow directions indicated by arrow 206 so as to reciprocate the piston means likewise within cylinder 200. During such reciprocation, the rack teeth 212 of piston rod 210 mesh with the pinion output shaft teeth 214 so as to controllably rotate output shaft 126 in a desired direction, including the extended portion or portions of shaft 126 which project from housing means 34 (as illustrated in present FIG. 6).

As an example of the manner in which the present hydraulic rotary motor may be incorporated into the lifting apparatus of present FIG. 2 for powering the actuating lift arms 122 thereof, piston rod 210 may be moved to its dotted line position 210' (FIG. 5) by proper introduction of hydraulic fluid into port 164 and out from ort 162 of housing means 134, thus moving rod 210 upward. Such movement of piston rod 210 rotates output shaft 126 in the direction of arrow 228 so that arm or arms 122 secured to the end or ends of output shaft 126 emerging from housing means 134 is (are) moved in the direction of arrow 216 to its dotted line position 122', on the way to raising and inverting a movable carriage for dumping the contents of a receptacle mounted on such carriage.

Since the hydraulic rotary motor of FIGS. 5 and 6 is essentially sealed, as discussed above, such rotary motor may be used in a variety of power drive applications in virtually any orientation. The diameter of the respective cylinder and piston means may be selectively varied and the number of cylinders used in a given application may also be varied, so as to provide adequate output power on shaft 126 thereof to meet needed torque requirements for a given load. In general, the power unit output torque capacity (a function of cylinder size and number) should increase correspondingly with increasing load arm length to accommodate the additional torque requirements generated by the increased lever arm length. For use in driving a lifting apparatus as in present FIG. 2, two cylinders (such as in present FIG. 6) form one preferred configuration, and may be provided with diameters generally in a range of from about two to about five inches, with the resulting total width of the unit (in its folded position, i.e. lowered, upright position) being generally in a range from about four to about eight inches. Obviously, various embodiments of selected capacities (virtually without limitation) may be practiced by those of ordinary skill in the art to meet particular load requirements without departing from the spirit and scope of the present invention.

Figure 7:
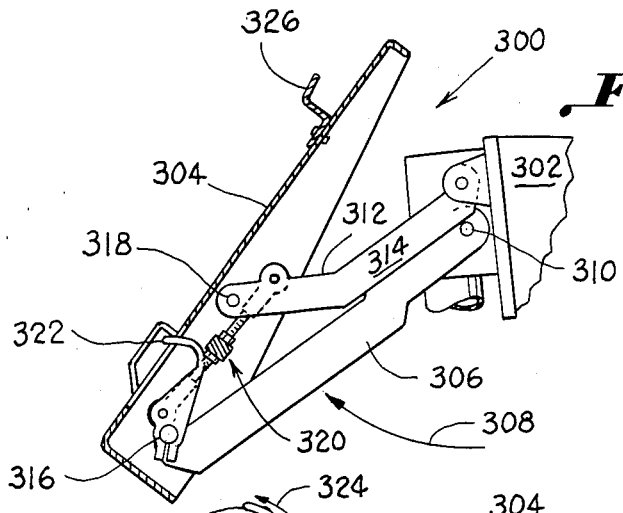
FIGS. 7–9 illustrate side views taken at selected progressive intervals during a dumping cycle for an exemplary embodiment of a lifting apparatus in accordance with the present invention.
Figure 8:
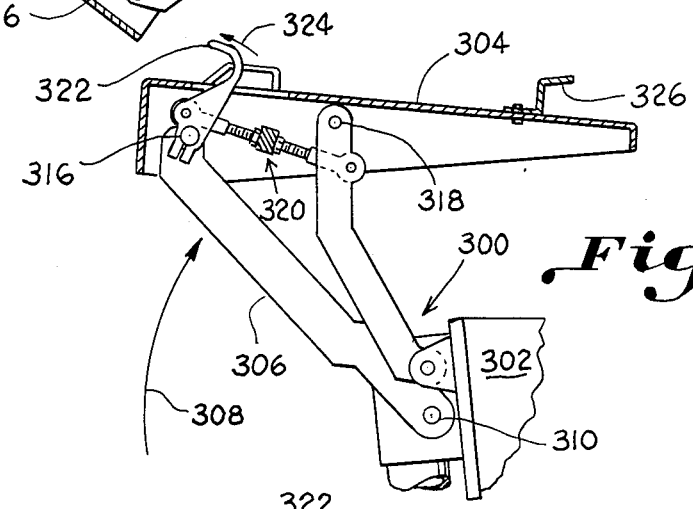
Figure 9:
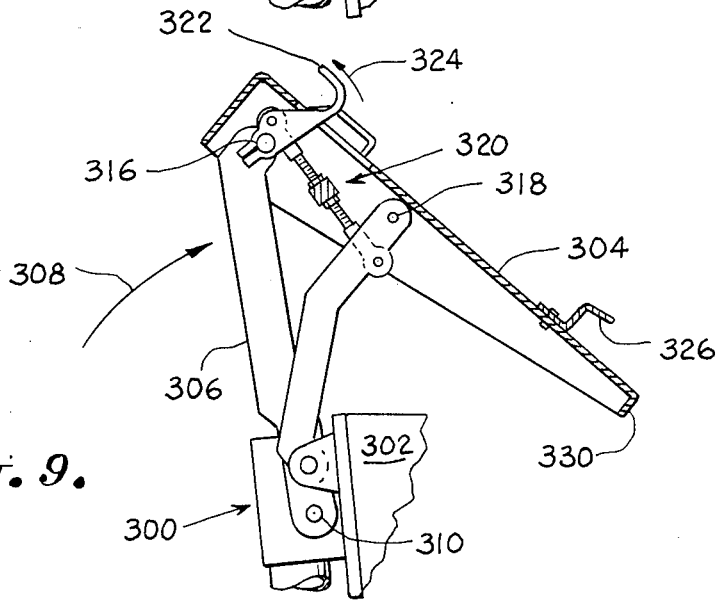
Figure 2:
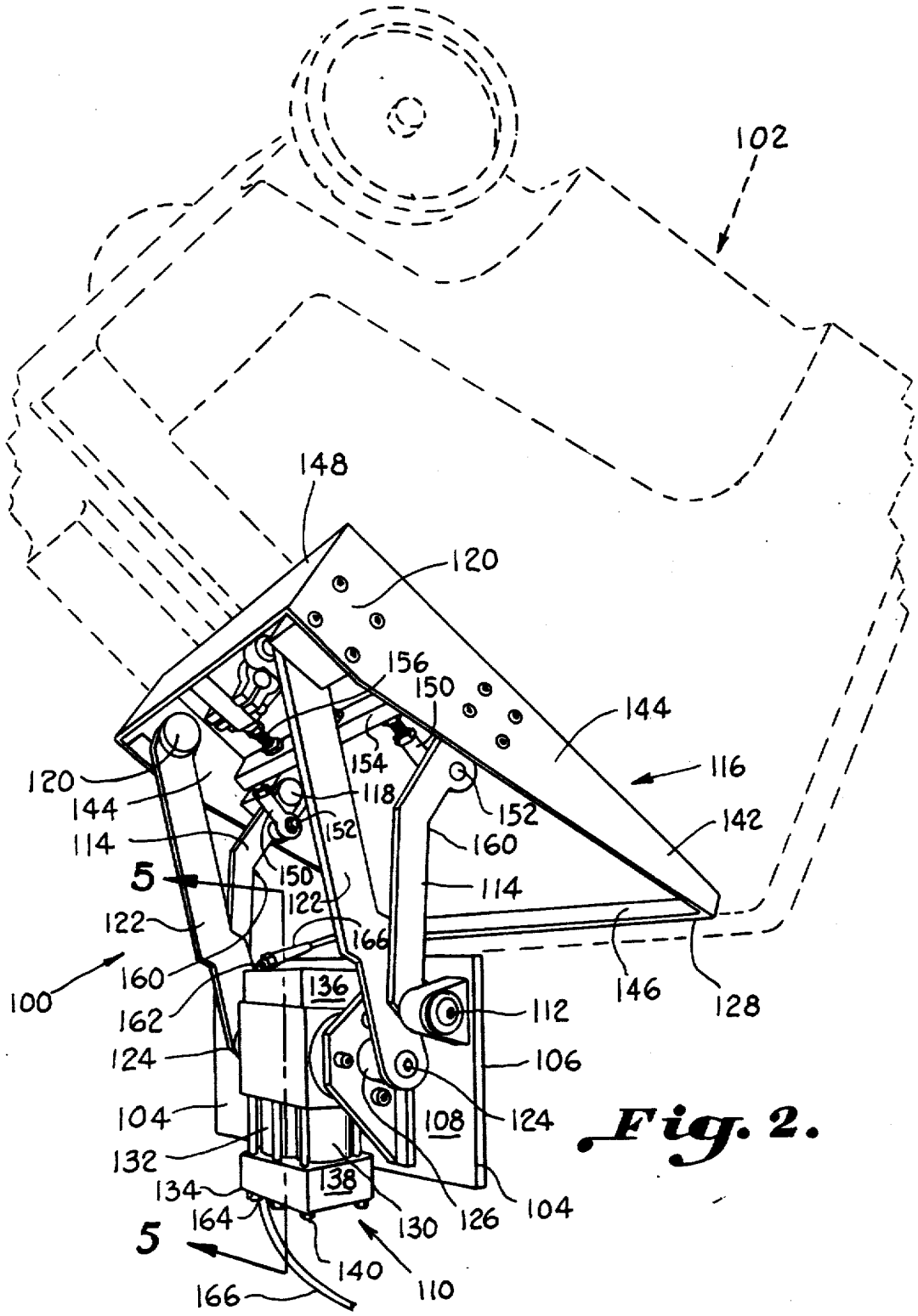

FIGS. 7 through 9 summarize operation of a dumping cycle for a lifting apparatus in accordance with the present invention, further combined with a hydraulic rotary motor in accordance with this invention, as presently disclosed in FIGS. 2, 5, and 6.

In general, a lifting apparatus 300 is mounted on a substantially vertical platform 302 (such as the rear bumper of a trash collecting vehicle) for controllably raising and inverting a movable carriage 304. A fully lowered, upright position of such movable carriage 304 is represented by present FIGS. 1 and 4 (the solid line illustration thereof). Operation of lift device 300 moves movable carriage 304 continuously between such fully lowered position and a fully raised, substantially inverted position thereof (as in present FIGS. 2 and 9). Longer arms 306 are progressively rotated in the direction of arrows 308 about output shaft 310 to which such arms are fixedly secured, and which shaft is preferably rotated through approximately 180° between the fully lowered and fully raised positions of movable carriage 304. The bore stroke of the piston means within the cylinder of the rotary motor of FIGS. 5 and 6 may be varied so as to adjust the rotational limits of output shaft 310 for particular applications, as understood by those of ordinary skill in the art.

As shown in the first intermediate phase (FIG. 7), the bend 312 in shorter arms 314 maintains the coplanar relationship of such shorter arms with longer arms 306 for as long as possible while permitting substantial separation between pivot points 316 and 318 of arms 306 and 314, respectively. As discussed in detail above with reference to FIGS. 2–4, various linkage members (linkage means 320 generally) are actuated during the dumping cycle so as to advance movable engagement member 322 in the direction of arrow 324 therefor so as to oppose fixed engagement member 326 and retain a receptacle to be dumped which is received on movable carriage 304.

Once the contents of a receptacle are dumped, the lifting apparatus is controlled for lowering carriage 304 (i.e. the progression of operation goes from FIG. 9 towards FIG. 7 until the orientation of the solid line illustration of FIG. 4 is again obtained), during which the movable engagement element 322 is automatically retracted so as to release the receptacle by the time the lowered, upright position of carriage 304 is regained.

FIG. 9 particularly illustrates the advantage of the present invention with respect to projecting the contents of a receptacle carried on carriage 304 up into the refuse-receiving opening of a typical refuse-gathering vehicle. In other words, the leading edge 330 of movable carriage 304, which is adjacent the opening out which the receptacle contents are dumped (see FIG. 2), is projected a predetermined distance beyond mounting of unit 300 onto substantially vertical structure 302. In one exemplary embodiment, where the length of arms 306 is about 16 inches, the forward edge 330 may be projected up into the receiving truck approximately 12 to 14 inches, depending in part on the separation between pivot points 316 and 318 on carriage 304.

In testing, a prototype lifting apparatus having 16 inch main arms (i.e. those secured to the output shaft), using a hydraulic rotary motor as in present FIGS. 5 and 6, with a pair of cylinders each having diameters of about 2½ inches, was able to lift a 200 pound weight through approximately 11,000 lift cycles without any maintenance problems whatsoever. The number of repeated cycles is equivalent to approximately one year or slightly longer of service in the field for such a lifting apparatus used on a garbage vehicle making rounds in a residential area. The overall collapsed width of such a 16 arm unit was only 4¾ inches, while the throw or projection up into the truck of the receptacle forward edge was 12 to 14 inches. Accordingly, such exemplary embodiment substantially overcomes the drawbacks and disadvantages of typical prior art constructions, as discussed above in the Background of the Invention.

While exemplary embodiments of the present invention have been discussed in particular detail, numerous modifications and variations thereto may be practiced. For example, instead of varying the length of the arms means, or the distance between their respective pivot points on the movable carriage, in order to change the lateral translation of such carriage up into a garbage-receiving vehicle, a plurality of holes may be provided in sides 144 of movable carriage 116 so that the pivot points 118 of shorter arms 114 may be varied to similarly change the lateral translation. Corresponding changes in the lengths of linkages 150 would also obviously be made in order to permit operation of the movable engagement feature of this invention.

Also, the actuating arms of a lift apparatus in accordance with the present invention may be powered externally, rather than by an axially internal drive unit, as illustrated in present FIG. 2. Thus, a lifting apparatus in accordance with this invention need not utilize the particular hydraulic rotary motor presently disclosed. Similarly, such hydraulic rotary motor may be utilized for drive applications other than with a lifting apparatus. All such modifications and variations, and alternative applications of presently disclosed features, are intended to come within the spirit and scope of the present invention. Furthermore, the language presently used to describe the exemplary embodiments is by way of description and example only, and is not intended to be limiting, which limitations are set forth only in the appended claims.

What is claimed is:

1. An apparatus for dumping the contents of a receptacle into a refuse-gathering vehicle adapted for gathering such contents, said apparatus comprising:

a support frame adapted to be mounted onto a refuse-gathering vehicle;

drive means, supported by said support frame, and having a rotatable output shaft, said drive means controllably positioning the rotary orientation of said output shaft;

a carriage adapted for carrying a receptacle for dumping of the contents thereof, said carriage being pivotably supported relative said apparatus for controlled movement with respect thereto;

first arm means for pivotably supporting said carriage relative said output shaft;

second arm means for pivotably supporting said carriage relative said output shaft; wherein said carriage comprises a substantially planar member oriented in a generally vertical position when in a lowered, upright position thereof, and having an engagement member on an outwardly facing side thereof adapted for engaging a handle of a conventional refuse receptacle;

said second arm means comprise a pair of arms fixedly received on opposing respective ends of said drive means output shaft for being rotated therewith, and pivotably mounted adjacent a base portion of said planar carriage member;

said first arm means comprise a pair of arms pivotably supported on said support frame with pivot axes co-planar with the rotation axis of said output shaft but displaced vertically thereabove, the other ends of said first arm means pair of arms being pivotably mounted along opposing sides of said planar carriage member, respectively displaced from the base portion pivot points thereof for said second arm means pair of arms; and said first pair of arms each have respective bends therein so as to maximize displacement of their pivot points on said carriage from those of said second pair of arms while also providing straight portions for forming a co-planar arrangement of said arm means whenever said carriage is in said lowered position thereof; and further wherein selected operation of said drive means causes controlled pivoting of said carriage on respective ends of said first and second arm means, between said lowered, upright position of said carriage for receiving a receptacle thereon engaged with said engagement member and a relatively raised, inverted position of said carriage for emptying a receptacle received thereon.

2. An apparatus as in claim 1, wherein:

said first and second arm means have different respective lengths;

whereby said carriage is projected a predetermined lateral distance into the refuse-gathering vehicle when placed in said raised, inverted position thereof so that respective dumping of the contents of successive receptacles can be accomplished without requiring compaction of such dumped contents after each such dumping, and wherein said predetermined lateral distance of projection is determined by the selected respective lengths of said first and second arm means and the relative displacement of said established pivot axes thereof.

3. An apparatus as in claim 1, wherein said engagement member comprises engagement means, operative during movement of said carriage substantially towards, through, and from said relatively raised, inverted position thereof, for maintaining engagement of said carriage with a receptacle carried thereby throughout dumping of such receptacle.

4. An apparatus as in claim 1, wherein:

said drive means comprises a hydraulically-actuated rotary motor, the rotatable output shaft of which is positioned substantially perpendicular to the plane of movement of said carriage between said two positions thereof, said drive shaft extending completely through said rotary motor so as to have two respective drive ends.

5. An apparatus as in claim 4, wherein said rotary motor includes rack and pinion gear teeth respectively supported on a reciprocal piston rod and on a rotatable portion of said output shaft passing through said rotary motor, and wherein said rack and pinion teeth engage one another within a cylinder formed by said rotary motor, such gear teeth being immersed in hydraulic fluid within such cylinder so as to minimize wear thereof.

6. An apparatus as in claim 1, wherein said respective pair of arms of said second arm means are longer than those of said first arm means, all four of such arms being pivoted about axis points relative said support frame in a substantially common vertical plane with their ends supporting said carriage at displaced intervals thereon, so that movement of said carriage into said relatively raised, inverted position thereof causes said carriage to be laterally projected a predetermined distance into the interior of the refuse-gathering vehicle with which it is used.

7. An apparatus as in claim 6, wherein said first arm means are pivoted about respective pivot points located in said common vertical plane axially outward of respective pivot points for said second arm means in such plane, whereby all four arms of said first and second arm means may be nested in substantially coplanar alignment whenever said carriage resides in said lowered position thereof, while forming substantially triangular-shaped support structures with said carriage whenever said carriage is placed in said raised position thereof.

8. An apparatus as in claim 1, wherein said apparatus has a relatively flat profile whenever said carriage thereof is placed in said lowered position thereof, whereby said apparatus is adapted to be mounted onto a refuse-gathering vehicle of a type having either a rear opening for the receipt of receptacle contents within such vehicle, or a side opening for the receipt of receptacle contents within such vehicle, said support frame being mounted substantially adjacent the lower lip of either of such type of opening.

9. An apparatus as in claim 1, wherein said engagement member comprises a hook member on an outwardly facing side of said carriage planar member and situated towards the upper edge thereof.

10. Receptacle dumping apparatus for mounting on a refuse-gathering vehicle having an opening therein adapted for receiving refuse into the vehicle, said apparatus comprising:

a support base for being integrally associated with such a refuse-gathering vehicle near the refuse-receiving opening thereof;

relatively narrow-width hydraulic power means, received on said support base, and having a rotatable output shaft, for selectively operating responsive to the controlled passage of hydraulic fluid therethrough so as to control the rotary orientation of said output shaft;

a receptacle carriage for carrying a receptacle for the dumping thereof; and dual paired projection arm means, pivotably associated with said support base and said power means, respectively, for supporting and selectively positioning said carriage, said arm means being operatively driven by said power means output shaft for lifting and projecting said carriage together with any receptacle carried thereby up into the vehicle refuse-receiving opening while substantially inverting said carriage so as to dump into the vehicle the contents of any such receptacle carried by the carriage;

said receptacle carriage comprises a substantially planar, enlarged member which is adapted to be brought into contact with a side of a receptacle to be dumped, said carriage having a projecting member in the planar face thereof for engaging a handle of such receptacle which permits such receptacle to be raised thereby;

one pair of said projection arm means comprises arms respectively fixedly secured to opposing ends of said output shaft so that the other ends of such one pair of arms define free ends which are swept out over a radius of the arms as such output shaft turns, such free ends being pivotably secured to points on a base portion of said receptacle carriage;

the other pair of said projection arm means have both of their respective ends pivotably mounted between pivot points on said receptacle carriage displaced from those of said one pair of arms and pivot points on said support base substantially coplanar with said output shaft, but axially outside thereof; and wherein said other pair of arms each have respective bends therein so as to maximize displacement of their pivot points on said receptacle carriage from those of said one pair of arms while also providing straight portions for forming a co-planar arrangement of said arm means whenever said receptacle carriage is in a lowered position thereof.

11. An apparatus as in claim 10, wherein:

said hydraulic power means includes a cylinder with a reciprocal piston rod received therein, said piston rod having gear teeth therealong for engaging pinion teeth supported about said output shaft and partially situated within said cylinder; and wherein hydraulic fluid passing through said cylinder powers said piston rod in the flow direction of such fluid so that said rack teeth of said piston rod engage said pinion teeth for in turn rotating said output shaft, the same hydraulic fluid also serving to internally lubricate said power means; and further wherein locating said rack teeth and pinion teeth within said cylinder minimizes the overall width of said power means transverse to the axis of said output shaft thereof to within a range of from about four to about eight inches, such width also substantially being the minimum width of said apparatus since said dual paired projection arm means thereof are pivotable downward into a co-planar alignment along respective sides of said power means.

12. An apparatus as in claim 11, wherein:

said hydraulic power means includes at least two of said cylinders, with said pinion output shaft transversely situated through a portion of both such cylinders, with respective piston rods and teeth thereof engaging said pinion teeth of said output shaft within each of the respective cylinders.

13. A receptacle lift for attachment to a refuse truck for lifting and dumping the contents of refuse-filled receptacles into such truck, said lift comprising:

a support plate having first and second opposing sides, said first side being adapted for attachment to a substantially vertical planar area of a refuse truck;

a movable carriage for receipt of a receptacle thereon, said carriage being continuously movable between a first position for initially receiving such a receptacle, and a second position for holding such receptacle in a substantially inverted position for dumping of the contents thereof into the refuse truck;

hydraulic rotary motor means, fixedly secured to said second side of said support plate, and having at least one hydraulically-drivable reciprocable piston and a rotatable drive shaft respectively supporting rack and pinion gear teeth, which rack and pinion gear teeth are mutually engaged and situated substantially within at least one cylinder of said rotary motor means, said drive shaft being rotatably driven by hydraulically-controlled reciprocable positioning of said piston within said cylinder, and said drive shaft further being disposed substantially parallel to said support plate, with opposing ends of said drive shaft emerging from said rotary motor means;

a first pair of carriage support arms, respective ends thereof being fixedly secured to one of each of said drive shaft opposing ends for rotation therewith, and the other ends of said first pair of arms being defined as relatively moving ends thereof which are pivotably engaged with said movable carriage at pivot points thereof; and a second pair of carriage support arms, respective ends thereof being pivotably engaged with said second side of said support plate, and the other ends of said second pair of arms being defined as relatively moving ends thereof which are pivotably engaged with said movable carriage at pivot points thereof displaced from those of said first pair of arms, said second pair of arms having respective bends therein for maximizing such pivot point displacement while also having straight portions for forming a co-planar arrangement of said arms whenever said movable carriage is in said first position thereof; wherein said movable carriage is continuously movable between said first and second positions thereof carried on said defined moving ends of said first and second respective pairs of support arms whenever said rotary motor means is controllably actuated, with said second position being projected into a refuse truck generally rearwardly of said support plate to a degree determined by said pivot point displacement and said bends in said second pairs of arms.

14. A receptacle lift as in claim 13, further comprising retaining means associated with said movable carriage for controllably retaining a receptacle received thereon, said retaining means including a first hook element relatively fixed to said carriage for initially retaining a receptacle whenever said carriage is in said first position thereof, and a second hook element relatively movable with respect to said carriage for retaining a receptacle thereon whenever said carriage is in said second, substantially inverted position thereof.

15. A receptacle lift as in claim 13, wherein:

said moving ends of said first pair of carriage support arms have pivot points adjacent a base of said movable carriage, while said moving ends of said second pair of carriage support arms have pivot points displaced from said carriage base;

said second pair of carriage support arms are positioned axially outside said first pair of carriage support arms so that all support arms are generally in co-planar alignment whenever said movable carriage is in said first position thereof, thereby minimizing the width of said receptacle lift; and wherein said movable carriage in said second position thereof is projected into a refuse-receiving opening of the refuse truck a predetermined distance, which distance is determined in accordance with the length of said support arms and the relative displacement of the respective pivot points, on the carriage for said first and second support arms.

16. A fluid-actuated motor, comprising:

a generally longitudinal, sealed housing having first and second ports in respective ends thereof defined by joined upper and lower blockheads for the passage of pressurized fluids through said housing, an output shaft opening substantially perpendicular to the longitudinal axis of said housing, and at least one cylinder defined within said housing along said longitudinal axis thereof and extending between said respective housing ends and corresponding blockheads;

only one piston matably received in said housing cylinder for fluid-powered reciprocable movement therein;

a piston rod, secured to said piston for movement therewith, and having gear teeth therealong, said piston rod being preferably semi-circular so as to longitudinally bisect its respective cylinder; and an output shaft rotatably received in said housing and extending through said output shaft opening thereof so as to project from said housing, said output shaft being provided with teeth thereabout and positioned with an axis of rotation perpendicular to the axis of reciprocation of said piston so that said output shaft teeth engage said piston rod gear teeth such that said output shaft is rotated by reciprocable movement of said piston; wherein the diameter of said output shaft including the teeth thereof is generally about the same as the diameter of said cylinder;

said housing further includes a slightly enlarged region cooperating with said upper blockhead for enclosing said output shaft; and further wherein a load secured to said output shaft projecting from said housing may be selectively powered by reciprocable movement of said at least one piston with controlled introduction of fluids through said housing ports, with only said first and second ports and said output shaft opening defined in the otherwise sealed housing for maintenance-free lubrication of said motor; whereby maximized output shaft torque is generated with minimized motor thickness.

17. A fluid-actuated motor as in claim 16, wherein:

said fluid comprises hydraulic fluids; and said output shaft teeth engage said piston rod gear teeth within said at lesat one cylinder, so that hydraulic fluid present in such cylinder constantly provides lubrication for said piston rod and output shaft gear teeth.

18. A fluid-actuated motor as in claim 17, wherein hydraulic fluid may be selectively passed through said first and second housing port in either direction within said housing so that said piston is controllably driven in either longitudinal direction thereof, whereby said output shaft may be rotatably driven in a desired direction.

19. A fluid-actuated motor as in claim 16, further comprising:

a second cylinder and mated piston and piston rod therein, such second piston rod also having gear teeth therealong for engaging teeth of said output shaft which is also at least partially located within said second cylinder; and wherein gear teeth supported on said piston rods comprise rack elements while teeth about said output shaft comprise pinion elements, whereby a rack and pinion construction is provided.

20. A fluid-actuated motor as in claim 16, wherein said output shaft includes two opposing ends, both of which project from said housing and are adapted for securement of a load thereto, such as actuating arms for a lift apparatus for dumping the contents of a receptacle into a refuse-gathering vehicle.

21. A fluid-actuated motor as in claim 20, wherein said cylinder has a diameter generally in the range of from about 2 inches to about 5 inches, and a sufficient piston reciprocating stroke length that said output shaft can be selectively rotated through at least 180°, and wherein said motor produces adequate torque about said output shaft thereof so as to lift a 200 pound load supported on the ends of actuator arms having a length generally in the range of from about 16 inches to about 30 inches and respectively secured on the two opposing ends of said output shaft which project from said housing.

22. A hydraulic rotary motor, comprising:

housing means adapted for the controlled flow of hydraulic fluids therethrough, said housing means being defined by joined upper and lower blockheads, and having hydraulic fluid ports on opposing ends thereof for the complementary flow of fluids therethrough relative said housing means;

piston means received in said housing means for controlled reciprocable movement therein actuated by the passage of hydraulic fluid through said housing means in one direction therethrough at a time, with complementary fluid exit and entry through said opposing end fluid ports, said piston means including a piston rod supporting rack teeth thereon; and pinion gear output shaft means, operatively associated with said housing means and projecting therefrom through an opening defined with a cooperating seal member to prevent escape of any hydraulic fluid from said housing means other than through one of said fluid ports thereof, for being rotatably driven by engagement of pinion teeth thereof with said rack teeth of said piston means;

whereby said output shaft means may be rotated for driving a load by controlled reciprocable movement of said piston means in one direction at a time with said pinion teeth and rack teeth immersed in said hydraulic fluid within said housing means for maintenance-free lubrication thereof.

23. A hydraulic rotary motor as in claim 22, wherein said housing means includes at least one cylinder for reciprocable receipt of said piston means, with said piston rod thereof being reciprocably movable on approximately one longitudinally bi-sected side of said cylinder, and said output shaft means being receivable in generally the other longitudinally bisected side of said cylinder so that engagement of said pinion and rack teeth is provided within said cylinder, whereby hydraulic fluid received in such cylinder provides lubrication for such teeth.

24. A hydraulic rotary motor as in claim 23, wherein said output shaft means is rotatably mounted transversely to the direction of movement of said piston rod, and includes two opposing ends which project from said housing means, both of which are adapted for rotatably driving a load secured thereto.

25. A hydraulic rotary motor as in claim 24, further comprising a second cylinder substantially parallel with said first cylinder and radially displaced therefrom, such that rack teeth supported on a piston rod reciprocally received in such second cylinder also engage said pinion teeth of said output shaft means.

26. A hydraulic rotary motor as in claim 25, wherein said housing means upper and lower blockheads commonly capture respective ends of said two parallel cylinders, and said housing means further includes support bolts for interconnecting such two blockheads.

27. A hydraulic rotary motor as in claim 25, wherein:

said piston means includes a piston head reciprocally movable within said cylinder and substantially of mating diameter therewith while permitting adequate clearance for said piston means reciprocal movement; and said piston rod comprises an elongated generally semi-circular shaped element extending from one side of said piston head longitudinally along said cylinder, and having said rack teeth thereon relatively adjacent the center of said cylinder for engaging said pinion teeth which are also situated near such cylinder center.

* * * * *

REEXAMINATION CERTIFICATE (1451st)

United States Patent [19] [11] B1 4,773,812

Bayne et al. [45] Certificate Issued Apr. 16, 1991

[54] RECEPTACLE LIFT AND SLIM PROFILE POWER UNIT THEREFOR

[75] Inventors: Jimmy O. Bayne; Robert E. Wyman, both of Simpsonville, S.C.

[73] Assignee: Bayne Machine Works, Inc.

Reexamination Request:
No. 90/001,993, Apr. 10, 1990

Reexamination Certificate for:

| | |
|---|---|
| Patent No.: | **4,773,812** |
| Issued: | **Sep. 27, 1988** |
| Appl. No.: | **44,045** |
| Filed: | **Apr. 29, 1987** |

[51] Int. Cl.[5] ..... B65F 3/02

[52] U.S. Cl. ..... 414/408; 92/136; 414/421

[58] Field of Search ..... 414/303, 406, 408, 420, 414/421, 425; 92/136, 147; 74/89.17, 30

[56] References Cited

U.S. PATENT DOCUMENTS

| | | | |
|---|---|---|---|
| 2,681,581 | 6/1954 | Pearson | 92/136 X |
| 3,040,717 | 6/1962 | Rumsey | 92/136 X |
| 3,179,015 | 4/1965 | Kurt | 92/136 X |
| 3,327,876 | 6/1967 | Kolling | 414/406 |
| 3,338,140 | 8/1967 | Sheesley | 92/136 X |
| 3,498,187 | 3/1970 | Stringfellow | 92/136 X |
| 3,738,516 | 6/1973 | Wells | 414/406 X |
| 3,747,785 | 7/1973 | Dahlin | 414/406 X |
| 3,931,901 | 1/1976 | Jones | 414/406 |
| 4,167,897 | 9/1979 | Bunyard | 92/136 X |
| 4,365,922 | 12/1982 | Borders | 414/406 |
| 4,489,640 | 12/1984 | Olson | 92/136 X |
| 4,545,288 | 10/1985 | Burke | 92/136 X |
| 4,613,271 | 9/1986 | Naab | 414/421 X |

FOREIGN PATENT DOCUMENTS 1240776 11/1967 Fed. Rep. of Germany .

*Primary Examiner*—David A. Bucci

[57] ABSTRACT

A lifting apparatus includes two pairs of lift arms having respective displaced pivot points on a movable carriage for projecting such carriage up into a refuse-receiving opening of a garbage truck, and in an inverted position so as to dump the contents of a receptacle held on such carriage. The two pairs of arms are also axially nested in a co-planar orientation when the carriage is in its fully lowered position, so as to minimize the overall width of the lifting apparatus. A particular hydraulic rotary motor having a relatively thin width may be used to actuate the apparatus. The hydraulic rotary motor utilizes meshed rack and pinion teeth generally within the confines of a cylinder thereof for minimizing the width of the cylinder block. Also, the rack and pinion teeth remain enclosed within such cylinder immersed in hydraulic fluid passing therethrough so as to lubricate the moving components for prolonging their service life with less maintenance. A plurality of cylinders may be aligned in parallel, and share a common pinion gear output shaft, with each cylinder having a reciprocating piston rod supporting rack teeth for engagement with such pinion gear. A lifting apparatus as presently described in combination with the disclosed hydraulic rotary motor can have minimized width while still being capable of repetitively handling full weight loads with reduced maintenance and projecting same a selected distance up into a garbage truck, which also reduces the need for successive compaction of the dumped receptacle contents after each dumping cycle.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-15 is confirmed.

Claims 22-24 are cancelled.

Claims 16, 19-21, and 25 are determined to be patentable as amended.

Claims 17, 18, 26 and 27, dependent on an amended claim, are determined to be patentable.

New claims 28-31 are added and determined to be patentable.

16. [A fluid-actuated] *A receptacle lift for attachment to a refuse truck for lifting and dumping the contents of refuse-filled receptacles into such truck, said lift comprising:*

*a support plate having first and second opposing sides, said first side being adapted for attachment to a planar area of a refuse truck;*

*a movable carriage for receipt of a receptacle thereon, said carriage being continuously movable between a first position for initially receiving such a receptacle, and a second position for holding such receptacle in a substantially inverted position for dumping of the contents thereof into the refuse truck;*

*a hydraulically actuated motor for moving said carriage between said first and second position*

*said hydraulically-actuated* motor comprising:

a generally longitudinal, sealed housing having first and second ports in respective ends thereof defined by joined upper and lower blockheads for the passage of pressurized fluids through said housing, an output shaft opening substantially perpendicular to the longitudinal axis of said housing, and at least one cylinder defined within said housing along said longitudinal axis thereof and extending between said respective housing ends and corresponding blockheads;

*a longitudinal axis of said cylinder being parallel to the longitudinal axis of said housing;* only one piston matably received in said housing cylinder for fluid-powered reciprocable movement therein;

a piston rod, secured to said piston for movement therewith, and having gear teeth therealong, said piston rod being preferably semi-circular so as to longitudinally bisect its respective cylinder; and an output shaft rotatably received in said housing and extending through said output shaft opening thereof *parallel to said planar area of said refuse truck* so as to project from said housing, said output shaft being provided with teeth thereabout and positioned with an axis of rotation perpendicular to the axis of reciprocation of said piston so that said output shaft teeth engage said piston rod gear teeth such that said output shaft is rotated by reciprocable movement of said piston; wherein the diameter of said output shaft including the teeth thereof is generally about the same as the diameter of said cylinder;

said housing further includes a slightly enlarged region cooperating with said upper blockhead for enclosing said output shaft; [and further wherein]

*a second cylinder spaced laterally from said first cylinder with the longitudinal axis of said second cylinder being parallel to the longitudinal axis of said first mentioned cylinder,*

*a piston matably received in said second cylinder with a piston rod carried thereon, said piston rod of said second cylinder also having gear teeth therealong for engaging teeth of said output shaft and being preferably semi-circular so as to longitudinally bisect said second cylinder;*

*said piston rod of said first mentioned cylinder and said second piston rod being laterally spaced along said output shaft from each other and being positioned on the same side of said output shaft within said housing; and further wherein;* a load secured to said output shaft projecting from said housing may be selectively powered by reciprocable movement of said [at least one piston] *pistons* with controlled introduction of fluids through said housing ports, with only said first and second ports and said output shaft opening defined in the otherwise sealed housing for maintenance-free lubrication of said motor; whereby maximized output shaft torque is generated with minimized motor thickness.

19. [A fluid-actuated motor as in claim 16 further comprising:] *A fluid-actuated motor, comprising:*

*a generally longitudinal, sealed housing having first and second ports in respective ends thereof defined by joined upper and lower blockheads for the passage of pressurized fluids through said housing, an output shaft opening substantially perpendicular to the longitudinal axis of said housing, and at least one cylinder defined within said housing along said longitudinal axis thereof and extending between said respective housing ends and corresponding blockheads;*

*only one piston matably received in said housing cylinder for fluid-powered reciprocable movement therein;*

*a piston rod, secured to said piston for movement therewith, and having gear teeth therealong, said piston rod being preferably semicircular so as to longitudinally bisect its respective cylinder; and*

*an output shaft rotatably received in said housing and extending through said output shaft opening thereof so as to project from said housing, said output shaft being provided with teeth thereabout and positioned with an axis of rotation perpendicular to the axis of reciprocation of said piston so that said output shaft teeth engage said piston rod gear teeth such that said output shaft is rotated by reciprocable movement of said piston; wherein*

*the diameter of said output shaft including the teeth thereof is generally about the same as the diameter of said cylinder;* a second cylinder and mated piston and piston rod therein, such second piston rod also having gear teeth therealong for engaging teeth of said output shaft which is also at least partially located within said second cylinder; and wherein gear teeth supported on said piston rods comprise rack elements while teeth about said output shaft comprise pinion elements, whereby a rack and pinion construction is provided[.];

*said housing further includes a slightly enlarged region cooperating with said upper blockhead for enclosing said output shaft; and further wherein*

*a load secured to said output shaft projecting from said housing may be selectively powered by reciprocable movement of said at least one piston with controlled introduction of fluids through said housing ports, with only said first and second ports and said output shaft opening defined in the otherwise sealed housing for maintenance-free lubrication of said motor; whereby maximized output shaft torque is generated with minimized motor thickness.*

20. [A fluid-actuated motor as in claim 16, wherein] *A fluid-actuated motor, comprising:*

*a generally longitudinal, sealed housing having first and second ports in respective ends thereof defined by joined upper and lower blockheads for the passage of pressurized fluids through said housing, an output shaft opening substantially perpendicular to the longitudinal axis of said housing, and at least one cylinder defined within said housing along said longitudinal axis thereof and extending between said respective housing ends and corresponding blockheads;*

*only one piston matably received in said housing cylinder for fluid-powered reciprocable movement therein;*

*a piston rod, secured to said piston for movement therewith and having gear teeth therealong, said piston rod being preferably semi-circular so as to longitudinally bisect its respective cylinder;*

*an output shaft rotatably received in said housing and extending through said output shaft opening thereof so as to project from said housing, said output shaft being provided with teeth thereabout and positioned with an axis of rotation perpendicular to the axis of reciprocation of said piston so that said output shaft teeth engage said piston rod gear teeth such that said output shaft is rotated by reciprocable movement of said piston; wherein*

*the diameter of said output shaft including the teeth thereof is generally about the same as the diameter of said cylinder;* said output shaft includes two opposing ends, both of which project from said housing and are adapted for securement of a load thereto [such as actuating arms for a lift apparatus for dumping the contents of a receptacle into a refuse-gathering vehicle];

*said load including a lift apparatus for dumping the contents of a receptacle into a refuse-gathering vehicle; and*

*actuating arms forming part of said lift apparatus connected to said opposing ends of said output shaft;*

*said housing further includes a slightly enlarged region cooperating with said upper blockhead for enclosing said output shaft; and further wherein*

*said load secured to said output shaft projecting from said housing may be selectively powered by reciprocable movement of said at least one piston with controlled introduction of fluids through said housing ports, with only said first and second ports and said output shaft opening defined in the otherwise sealed housing for maintenance-free lubrication of said motor;*

*whereby maximized output shaft torque is generated with minimized motor thickness.*

21. [A fluid-actuated motor as in claim 20,] *A fluid-actuated motor, comprising:*

*a generally longitudinal, sealed housing having first and second ports in respective ends thereof defined by joined upper and lower blockheads for the passage of pressurized fluids through said housing, an output shaft opening substantially perpendicular to the longitudinal axis of said housing, and at least one cylinder defined within said housing along said longitudinal axis thereof and extending between said respective housing ends and corresponding blockheads;*

*only one piston matably received in said housing cylinder for fluid-powered reciprocable movement therein;*

*a piston rod, secured to said piston for movement therewith, and having gear teeth therealong, said piston rod being preferably semi-circular so as to longitudinally bisect its respective cylinder; and*

*an output shaft rotatably received in said housing and extending through said output shaft opening thereof so as to project from said housing, said output shaft being provided with teeth thereabout and positioned with an axis of rotation perpendicular to the axis of reciprocation of said piston so that said output shaft teeth engage said piston rod gear teeth such that said output shaft is rotated by reciprocable movement of said piston; wherein*

*the diameter of said output shaft including the teeth thereof is generally about the same as the diameter of said cylinder;*

*said output shaft includes two opposing ends, both of which project from said housing and are adapted for securement of a load thereto, such as actuating arms for a lift apparatus for dumping the contents of a receptacle into a refuse-gathering vehicle;*

*said housing further includes a slightly enlarged region cooperating with said upper blockhead for enclosing said output shaft; and further wherein*

*a load secured to said output shaft projecting from said housing may be selectively powered by reciprocable movement of said at least one piston with controlled introduction of fluids through said housing ports, with only said first and second ports and said output shaft opening defined in the otherwise sealed housing for maintenance-free lubrication of said motor; whereby maximized output shaft torque is generated with minimized motor thickness;* wherein said cylinder has a diameter generally in the range of from about 2 inches to about 5 inches, and a sufficient piston reciprocating stroke length that said output shaft can be selectively rotated through at least 180°, and wherein said motor produces adequate torque about said output shaft thereof so as to lift a 200 pound load supported on the ends of actuator arms having a length generally in the range of from about 16 inches to about 30 inches and respectively secured on the two opposing ends of said output shaft which project from said housing.

25. A hydraulic rotary motor [as in claim 24 further], comprising:

*housing means adapted for the controlled flow of hydraulic fluids therethrough, said housing means being defined by joined upper and lower blockheads, and having hydraulic fluid ports on opposing ends thereof*

*for the complementary flow of fluids therethrough relative said housing means;*

*piston means received in said housing means for controlled reciprocably movement therein actuated by the passage of hydraulic fluid through said housing means in one direction therethrough at a time, with complementary fluid exit and entry through said opposing end fluid ports, said piston means including a piston rod supporting rack teeth thereon;*

*pinion gear output shaft means, operatively associated with said housing means and projecting therefrom through an opening defined with a cooperating seal member to prevent escape of any hydraulic fluid from said housing means other than through one of said fluid ports thereof, for being rotatably driven by engagement of pinion teeth thereof with said rack teeth of said piston means;*

*whereby said output shaft means may be rotated for driving a load by controlled reciprocable movement of said piston means in one direction at a time with said pinion teeth and rack teeth immersed in said hydraulic fluid within said housing means for maintenance-free lubrication thereof;*

*said housing means includes at least one cylinder for reciprocable receipt of said piston means, with said piston rod thereof being reciprocably movable on approximately one longitudinally bi-sected side of said cylinder, and said output shaft means being receivable in generally the other longitudinally bi-sected side of said cylinder so that engagement of said pinion and rack teeth is provided within said cylinder, whereby hydraulic fluid received in such cylinder provides lubrication for such teeth;*

*said output shaft means is rotatably mounted transversely to the direction of movement of said piston rod, and includes two opposing ends which project from said housing means, both of which are adapted for rotatably driving a load secured thereto;* a second cylinder substantially parallel with said first cylinder and radially displaced therefrom, such that rack teeth supported on a piston rod reciprocally received in such [second] cylinder also engage said pinion teeth of said output shaft means[.]; and

*means for supplying hydraulic fluid to said second cylinder so that said rack teeth on said piston rod of said second cylinder and said rack teeth of said piston rod of said first mentioned cylinder jointly drive said output shaft in one direction or the other.*

*28. A hydraulic rotary motor as in claim 25, wherein said piston rod of said first piston means and piston rod in said second cylinder are laterally spaced along said output shaft from each other and being positioned on the same side of said output shaft within said housing.*

*29. A receptacle lift for attachment to a refuse truck for lifting and dumping the contents of refuse-filled receptacles into such truck, said lift comprising:*

*a movable carriage for receipt of a receptacle thereon, said carriage being continuously movable between a first position for initially receiving such a receptacle, and a second position for holding such receptacle in a substantially inverted position for dumping the contents thereof into the refuse truck;*

*a hydraulically actuated rotary motor for moving said carriage between said first and second position including:*

*housing means adapted for the controlled flow of hydraulic fluids therethrough, said housing means being defined by joined upper and lower blockheads, and having hydraulic fluid ports on opposing ends thereof for the complementary flow of fluids therethrough relative said housing means;*

*piston means received in said housing means for controlled reciprocable movement therein actuated by the passage of hydraulic fluid through said housing means in one direction therethrough at a time, with complementary fluid exit and entry through said opposing end fluid ports, said piston means including a piston rod supporting rack teeth thereon;*

*pinion gear output shaft means, operatively associated with said housing means and projecting therefrom through an opening defined with a cooperating seal member to prevent escape of any hydraulic fluid from said housing means other than through one of said fluid ports thereof, for being rotatably driven by engagement of pinion teeth thereof with said rack teeth of said piston means;*

*means for connecting said movable carriage to said output shaft means;*

*whereby said output shaft means may be rotated for driving a load in the form of said movable carriage by controlled reciprocable movement of said piston means in one direction at a time with said pinion teeth and rack teeth immersed in said hydraulic fluid within said housing means for maintenance-free lubrication thereof;*

*said housing means includes one cylinder for reciprocable receipt of said piston means, with said piston rod thereof being reciprocably movable on approximately one longitudinally bi-sected side of said cylinder, and said output shaft means being receivable in generally the other longitudinally bi-sected side of said cylinder so that engagement of said pinion and rack teeth is provided within said cylinder, whereby hydraulic fluid received in such cylinder provides lubrication for such teeth;*

*said output shaft means is rotatably mounted transversely to the direction of movement of said piston rod, and includes two opposing ends which project from said housing means, both of which are adapted for rotatably driving said movable carriage secured thereto;*

*a second cylinder substantially parallel with said first cylinder and radially displaced therefrom, such that rack teeth supported on a piston rod reciprocally received in such second cylinder also engage said pinion teeth of said output shaft means;*

*means for securing said lift to a refuse truck; and*

*means for supplying hydraulic fluid to said second cylinder so that said rack teeth on said piston rod of said second cylinder and said rack teeth on said piston rod of said first mentioned cylinder jointly drive said output shaft in the same direction to move said carriage from said first position to said second position for dumping the contents of said receptacle into said refuse truck.*

*30. A receptacle lift as in claim 29, wherein said piston rod of said first piston means and piston rod in said second cylinder are laterally spaced along said output shaft from each other and being positioned on the same side of said output shaft within said housing to minimize the motor thickness while maximizing the output torque of said output shaft.*

*31. The receptacle lift as set forth in claim 29 wherein said means for securing said lift to a refuse truck comprises:*

*a support plate carried by said motor adapted to be attached to a planar area of a refuse truck.*

* * * * *